US005323816A

United States Patent [19]

Hoyaukin

[11] Patent Number: 5,323,816

[45] Date of Patent: Jun. 28, 1994

[54] MACHINE FOR JOINING TOGETHER MUTUALLY CROSSING RODS

[76] Inventor: Peter Hoyaukin, Stagneliusvägen 42 II, S-112 56 Stockholm, Sweden

[21] Appl. No.: 30,483

[22] PCT Filed: Aug. 30, 1991

[86] PCT No.: PCT/SE91/00571

§ 371 Date: Mar. 29, 1993

§ 102(e) Date: Mar. 29, 1993

[87] PCT Pub. No.: WO92/06260

PCT Pub. Date: Apr. 16, 1992

[30] Foreign Application Priority Data

Oct. 4, 1990 [SE] Sweden ..... 9003176

[51] Int. Cl.[5] ..... B21F 15/04

[52] U.S. Cl. ..... 140/57; 140/93.6; 140/119

[58] Field of Search .....140/53, 54, 57, 140/93 A, 96.3, 119

[56] References Cited

U.S. PATENT DOCUMENTS 3,368,590 2/1968 Welden .
3,391,715 7/1968 Thompson .
4,117,872 10/1978 Gott et al. .
4,362,192 12/1982 Furlong et al. .
4,640,319 2/1987 Walker .

FOREIGN PATENT DOCUMENTS 0190071 8/1986 European Pat. Off. .
1138207 10/1962 Fed. Rep. of Germany .
1434519 1/1969 Fed. Rep. of Germany .
2223099 11/1973 Fed. Rep. of Germany .
8801671 3/1988 PCT Int'l Appl. .
408384 9/1966 Switzerland .
2171038 8/1986 United Kingdom .
87/01313 3/1987 World Int. Prop. O. ..... 140/57

*Primary Examiner*—Lowell A. Larson
*Attorney, Agent, or Firm*—Sughrue, Mion, Zinn, Macpeak & Seas

[57] ABSTRACT

A machine for tying together mutually crossing rods with the aid of wire-ties includes a device 8, 9 having a curved wire-guide surface which is intended to be positioned so that it will surround a rod intersection point on three sides of the mutually crossing rods 6, 7. The machine also includes a mechanism 18–20 for feeding at least one wire to the device, so that the wire will be bent by the guide surfaces into a wire-stirrup which surrounds the intersection point on three sides, and a rotatable twisting head by means of which the free legs of the stirrup are twisted together on the fourth side of the intersection point. The machine also includes a feed tube 18 for feeding severed, straight wire-sections 16 of predetermined lengths, and the lower end of the feed tube is located above an opening in the twisting head positioned in line with a part of the guide surface. Mounted for axial movement in the tube is a device which functions to press wire-sections introduced into the tube in a downward direction and displace the wire-sections along the guide surface, to form a wire-stirrup.

9 Claims, 4 Drawing Sheets

MACHINE FOR JOINING TOGETHER MUTUALLY CROSSING RODS

BACKGROUND OF THE INVENTION

The present invention relates to a machine which is intended for joining together mutually crossing rods with the aid of wire-ties, and particularly for lashing or tying reinforcement rods, said machine including a wire guide device having a curved guide surface and being positioned so that the guide surface will substantially surround an intersection point of two rods on three sides thereof, means for feeding at least one wire to said device so that the wire is bent by said guide surface in a manner to form a wire-stirrup which embraces said intersection point on three sides thereof, and a rotatable twisting head by means of which the free legs of the wire-stirrup are twisted around each other on the fourth side of the rod intersection point.

The reinforcement rods or irons of tied mesh reinforcements are traditionally tied or lashed with the aid of simple, manually operated tools, and the task of tying the irons is therefore highly time-consuming, costly and laborious, and is liable to cause strain injuries to the workman involved, among other things. Such strain, or wear on the joints, is caused by the fact that when tying together the reinforcement irons of concrete slab reinforcements, floor structures or the like with the aid of present-day tools, it is necessary for the workman to remain stooped over long periods of time, therewith subjecting the spine to undue loads.

The reinforcement irons are normally tied together with the aid of pliers or "twisters" by means of which the ends of a wire-tie or stirrup positioned manually around the reinforcement rods at the various intersection points are intertwined to provide a firm and durable connection. Conventional tying of reinforcement rods is also encumbered with accident risks, particularly when working on roofs, bridges and the like, due to the stooped position in which the workman is forced to work, therewith placing the workman in danger of falling.

The present invention is based on the realization that the work of tying reinforcement rods can be made much more effective while eliminating, or substantially reducing the risk of injury, when tying can be effected with the aid of a tying machine which enables the workman to work in an upright position.

An automatic tying machine is known from DE-A1-1434519. This machine, however, is a hand-operated machine which requires the workman to stoop when tying the reinforcement bars of floor reinforcements and the like. Furthermore, the machine can only work with pre-bent wire-stirrups of standard sizes. The tying head used with this machine is also relatively complicated, and includes two parts which can be moved axially in relation to one another and which are intended to hold the legs of a wire-stirrup between said parts. This mechanism is highly susceptible to damage and to the presence of contaminants, because of the small tolerances and clearances involved, and is hardly suited for use on building sites.

WO-88/01671 describes a tying machine which enables tying to be effected in an upstanding position. The function of this machine also depends on the use of prefabricated standard-size wire-stirrups housed in a magazine.

In many instances, particularly within the building industries of different countries, tying is effected with the aid of relatively thin wire-ties which are bent to an appropriate stirrup-like shape by the workman on the working site, prior to placing the ties or stirrups over the point of intersection of, for instance, two reinforcement rods or bars.

There is at present no suitable machine which will facilitate this type of tying, in which pre-cut wire lengths are not formed into stirrup-like ties until the actual tying operation is commenced.

In an attempt to automatize tying operations with the use of relatively thin wires, there have earlier been proposed tying machines which include a spool from which wire is continuously taken and passed around the rods in conjunction with a tying operation. These machines have not been found successful in practice, probably due to their unrealibility in operation, among other things. When using such machines, it is also difficult to pass the end of the wire around the rods, in an open groove and up into a twisting head. Because of this, telescopically displaceable devices (see GB-A-2171038 and DE-A1-2223099) have been used, although these devices require a relatively large amount of free space beneath the rods that are to be tied together. These devices must also be provided with wire feed means and wire cutting means, which makes it difficult to run the machine on battery power, owing to the high energy consumption of such means. The machine described in the German patent specification also includes a wire aligning mechanism. The provision of such a mechanism is necessary owing to bending of the wire as it is taken from a spool, therewith complicating guiding of the wire. The use of a wire aligning mechanism also increases energy consumption and adds to the weight of the machine.

DE-B1-1138207 describes a machine which includes a hook-shaped device which requires a relatively large space on the underside of the rods to be tied together.

U.S. Pat. No. 3,368,590 describes a machine which, in order to ensure that the end of the wire is inserted into the twisting head, includes a chain mechanism which draws the end of the wire completely around the rods. This machine is relatively complicated and heavy and consumes a large amount of energy. CH-A-408384 teaches a machine in which the end of a wire is bent into the twisting head by means of a liftable plate. This machine is also relatively complicated, heavy and energy demanding.

SUMMARY OF THE INVENTION

The main object of the present invention is to provide a realiable tying machine which will facilitate and render more effective such tying operations as those which use straight wire-sections of given lengths, said wire-sections being bent to a stirrup-like shape in conjunction with the actual tying operation itself. Another object of the invention is to enable a tie to be made without requiring the workman to stoop.

These objects are achieved by means of a machine of the kind defined in the introductory paragraph which is characterized in that the machine further includes a feed tube for feeding cut, straight wire-sections of given lengths; in that the lower end of the tube is located above an opening in the twisting head located in line with a part of said guide surface; and in that disposed for axial movement in the tube is a device which coacts with a wire-section inserted in the tube in a manner to press down said wire-section and move said section along said guide surface so as to produce a wire-stirrup.

The use of straight wire-sections in accordance with the invention eliminates initial bending of the wires as they are drawn from a spool or drum. This eliminates the need for wire aligning and wire cutting devices, used in the earlier machines.

Because the wires are initially completely straight, the force required to feed the wires can be applied in a simpler manner than with the roller feed mechanisms previously used, these mechanisms being liable to bend the wire. In the case of one preferred embodiment, the wire is fed with the aid of a plunger which is moveable in the feed tube and which coacts with the upper end of respective wire-sections. A highly powerful and rapid feed movement can be obtained with this arrangement.

In order, among other things, to reduce the need for free space beneath the rods, which is highly desirable when tying reinforcement rods or bars, for example, it is preferred that the device provided with said curved guide surface includes two curved jaws which can be swung towards one another, and that the inner surfaces of these jaws are provided with open grooves for guiding said wire-sections.

Because it is necessary for the guide grooves to be open towards the rods, a high demand is placed on the curvature of the grooves, so that the forward end of the wire-stirrup will engage in the opening in the overlying twisting head. Accordingly, in accordance with one preferred embodiment of the present invention, the groove provided in the curved inner surface of that jaw which first receives the leading end of a wire section has a substantially circular curvature, whereas the radius of curvature of the groove in the other jaw is greater than the radius of curvature of the groove in the first jaw. This enables the end of said wire to engage the opening in the twisting head with a very high degree of accuracy, as the wire is advanced.

With the intention of further reducing the need for space beneath the rods, the jaws are preferably journalled so that when pivoted in relation to one another they are also moved axially. The jaw attachment means is preferably adjustable in an axial direction, so as to enable the machine to tie rods of mutually different diameters.

When intertwining the legs of a wire-stirrup, it is important that the legs are held securely in the twisting head. Accordingly, the twisting head will preferably include two rotatable disc-like bodies, each provided with a pair of openings for receiving the legs of a wire-stirrup, and the discs will be mounted for limited pivotal movement relative to one another so that the legs of a wire-stirrup are clamped firmly between the discs prior to intertwining said legs. In order to further ensure that the forward end of the wire will positively engage the openings in the disc-like bodies as the wire is advanced, these openings are preferably given an elongated form in the radial direction.

The twisting head is preferably mounted for axial movement in a sleeve surrounding said head, the lower end of said sleeve being intended to rest on the rods to be tied together. To this end, the bottom edge of the sleeve is preferably provided with two pairs of diametrically opposed recesses for receiving and correctly positioning the machine on the rods to be tied together. This axial movement of the twisting head thus facilitates positioning of the machine on the rods and forms a space necessary for receiving the ends of the wires in conjunction with a stirrup twisting operation.

BRIEF DESCRIPTION OF THE DRAWINGS

The invention will be described now in more detail with reference to an exemplifying embodiment thereof illustrated in the accompanying drawings, in which.

DETAILED DESCRIPTION OF THE PREFERRED EMBODIMENTS

Figure 1:
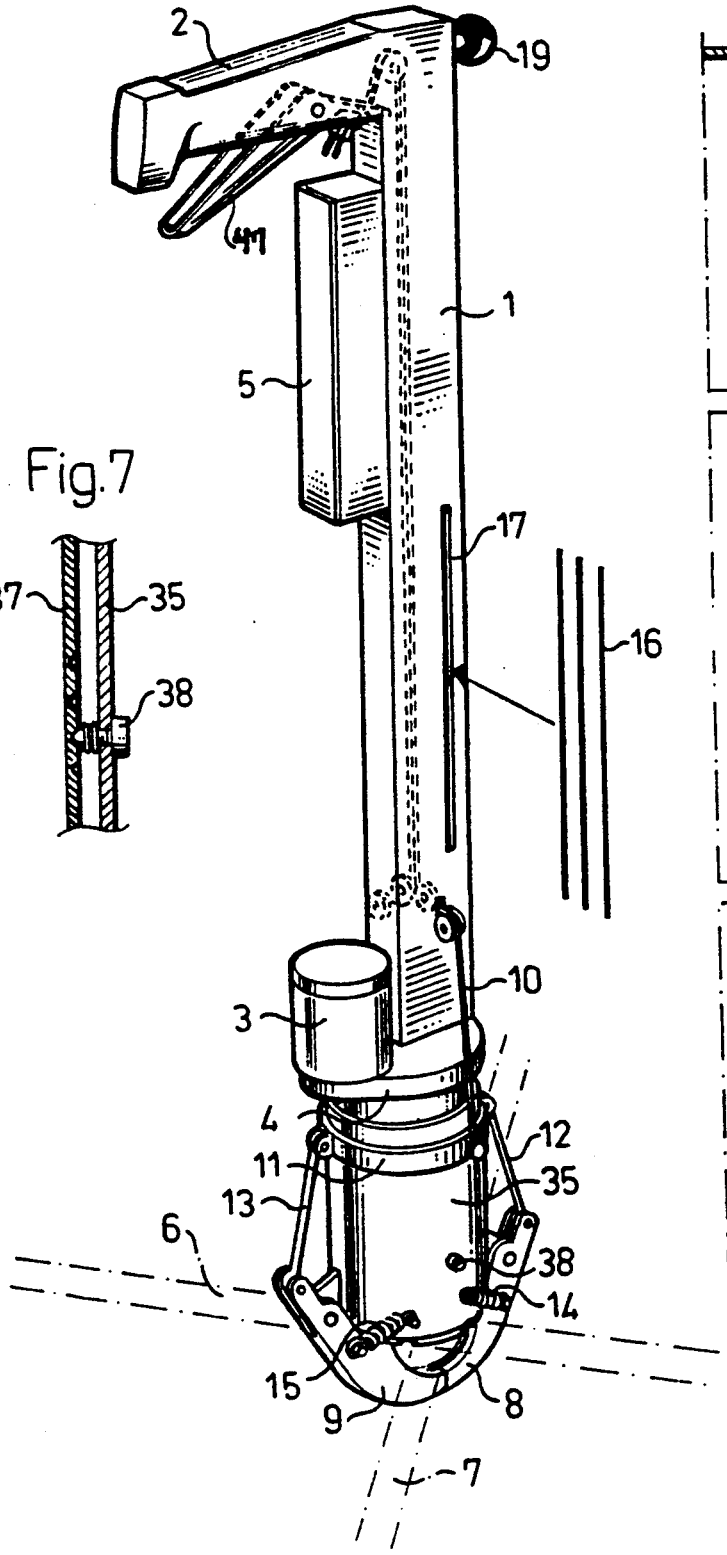
FIG. 1 is a perspective view of an inventive tying machine.

The machine illustrated in FIG. 1 includes an elongated casing 1 which is configured at one end, its upper end, in the form a handle 2. Attached to the other end of the casing, its bottom end, is an electric motor 3, which drives a gearbox 4. The motor is driven by a battery 5, mounted on the casing 1.

Shown in chain lines are two mutually crossing reinforcement rods 6, 7 which during the application of a wire-tie on three sides of the intersection point are embraced by two lower, pivotal jaws 8 and 9 for guiding a wire-tie and bending said tie to stirrup form, as described in more detail herebelow. The jaws are operated by means of lines 10, such that the jaws are swung outwards and away from one another when pressing down an operating lever 47. Each of the jaws 8, 9 is connected to a ring 11 by means of a respective operating arm 12 and 13, and the lines 10 are connected to the ring so as to enable the annulus to be lifted in response to depression of the lever 47 and therewith swing the jaws outwards. The jaws are returned to their inward position by means of two return springs 14 and 15 respectively.

Figure 2:
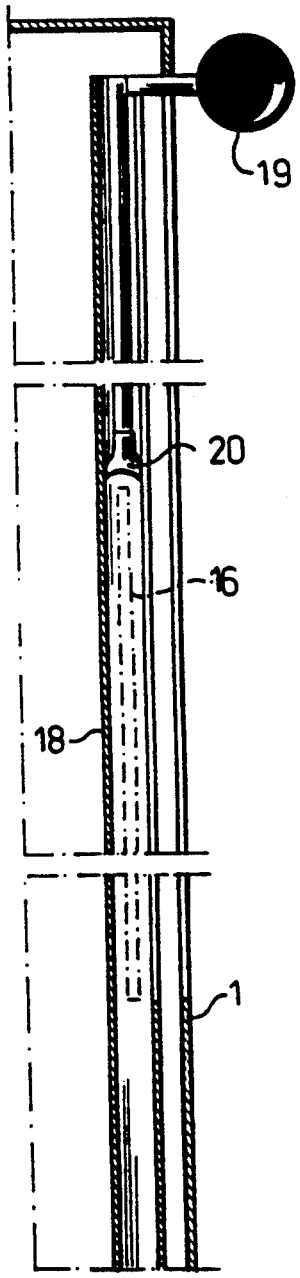
FIG. 2 is a part sectional view through an upper part of the machine illustrated in FIG. 1.

In the illustrated embodiment, straight wire-sections 16 intended to form wire-ties are fed through a slot 17 in the casing 1. As will be seen from FIG. 2, the wire-sections are fed from the slot into an internal feed tube 18, in which they are able initially to fall freely through a given distance and are then pressed down through a further distance with the aid of a plunger 20 moveable in the feed tube 18, this plunger movement being effected with the aid of a further handle 19. The plunger has a concave bottom surface and is a generally close fit with the inner wall of the tube 18, so as to avoid the risk of wire-sections jamming in the tube.

Figure 3:
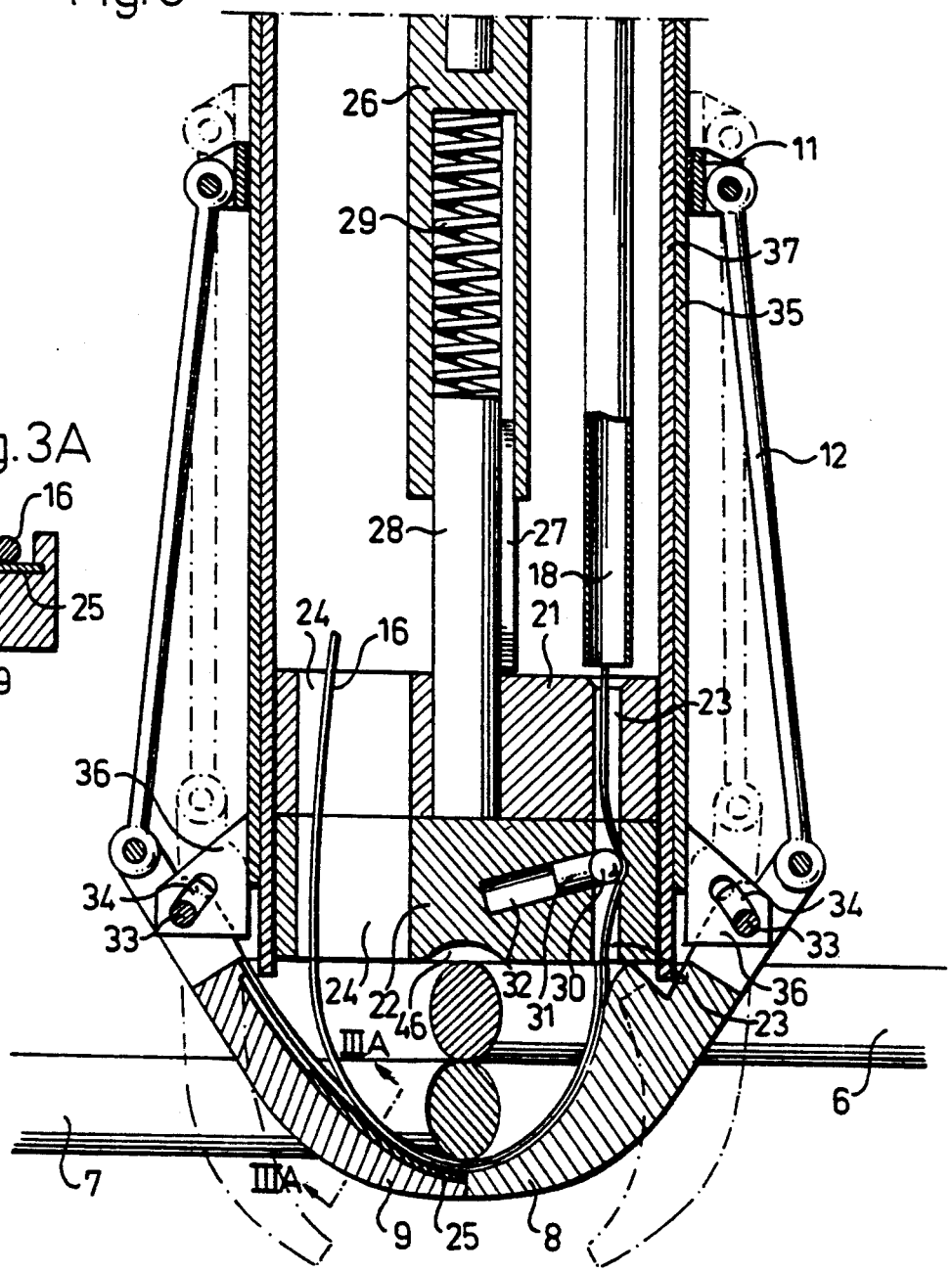
FIG. 3 is a sectional view of the lower part of the machine.
Figure 9:
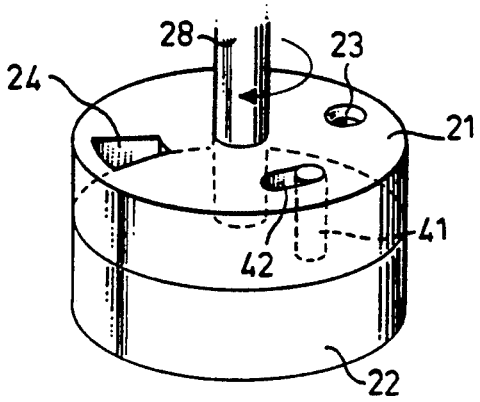
FIG. 9 is a schematic perspective view of the twisting head of said machine.

As shown in FIG. 3, and also in FIG. 9, the twisting head comprises two disc-shaped bodies 21 and 22, in which there are provided openings 23 for receiving a wire-section 16 fed down through the feed tube 18, said openings 23 being located opposite one another in the rest position of the head. Each of the bodies has a further opening 24 which lies diametrically opposite respective openings 23. As illustrated, these further openings may suitably have a wider radial extension, or a radially elongated form, in order to facilitate accommodation of the forward end of the wire-section 16.

The twisting head 21, 22 is driven by a shaft 26 which extends from the motor 3 and is connected, by means of a key 27, to an axle 28 which, in turn, is connected to the bottom disc-shaped body 22 of the twisting head. The axle 28 can move axially in a lower, sleeve-like part of the shaft 26, against the action of a spring 29. The reference numeral 30 identifies a ball which when the body 22 rotates is thrown outwardly by the centrifugal forces thus generated, so as to assist in holding the wire-section 16 firmly in the twisting head. The effect produced by the ball can be amplified with the aid of a weight 31, for example mercury. For the purpose of illustration, the ball and the weight have been shown in those positions which they adopt when the body 22 rotates rapidly. When the body is stationary, the ball and the weight will slide back into the channel 32 provided in the body 22.

As mentioned in the aforegoing, the jaws 8 and 9 can be caused to swing outwards by pulling-in the levers or rods 12 and 13, in response to the upper mounting sleeve 11 being drawn upwards with the aid of the lines 10. When the jaws swing about the journal pins 33, which when pulling respective rods 12 and 13 can be displaced in arcuate slots 34, the jaws 8 and 9 will be moved axi-ally upwards to some extent, to the positions illustrated in chain lines, while swinging outwards away from one another. This makes it possible to further reduce the space required beneath the reinforcement rods 6 and 7 for the movement of the jaws.

Figure 4:
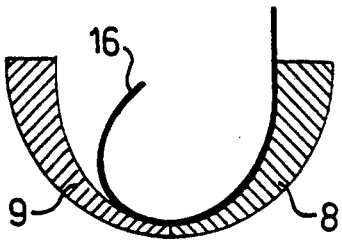
FIGS. 4 and 5 illustrate a wire-bending problem and the solution to this problem.
Figure 5:
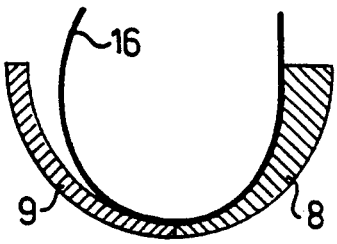

As will be seen from FIG. 3, the inner wire-section guide surface has the form of a substantially circular curved groove on the jaw 8. The corresponding guide surface on the opposite jaw 9, however, has a substantially larger radius of curvature. This has been found necessary in order to avoid the effect illustrated in FIG. 4, in which both of the jaws illustrated have the same radius of curvature. In this case, the wire-section 16 will not follow the guide surface on the jaw 9, but will be bent back towards the jaw 8. This renders the construction of a reliable and simple twisting head difficult, if not impossible. By giving the second jaw a flatter curvature, as illustrated in FIG. 5, the aforedescribed effect can be eliminated or at least controlled, so as not to jeopardize the functioning of the machine.

Figure 3A:
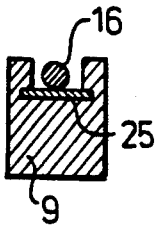
FIG. 3A is a sectional view taken on the line IIIA—IIIA in FIG. 3.

The reference numeral 25 identifies a thin plate or plastic disc which can be readily moved in the guide groove in the jaw 9, see also FIG. 3A. The presence of such a plate or disc is desirable because the forward end of the wire 16, particularly when the wire is thick and cut obliquely, has a tendency to bite into and score the bottom surface of the guide groove, which can result in the wire end fastening in the groove. This risk is eliminated by virtue of the fact that at the transition or crossover from the jaw 9, the wire-end will strike the plate 25 which is located on a lower level than said crossover point, and push the plate forwards somewhat. For the sake of simplicity, the plate 25 has been shown in its starting position in the various Figures, and will return to this position gravitationally when the jaws 8, 9 are opened. As will be understood, the plate 25 or like device can be omitted, particularly when using relatively soft wires, and also when the guide surface of respective jaws is made of a very hard material.

Thus, the machine illustrated in FIGS. 1 and 3 will function to feed-down a wire-section 16 rapidly and positively, since the wire-section on which the plunger 20 bears is completely straight. Furthermore, the aforedescribed configurations of the guide surfaces of respective jaws 8 and 9 result in positive bending of the wire-section to a predetermined stirrup form, so that the legs of the stirrup can be gripped effectively and twisted with the aid of the twisting head 21, 22.

Figure 7:
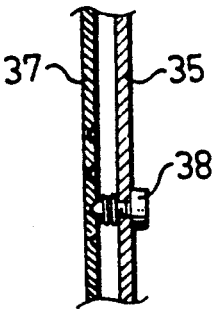
FIG. 7 illustrates a machine setting mechanism.
Figure 6:
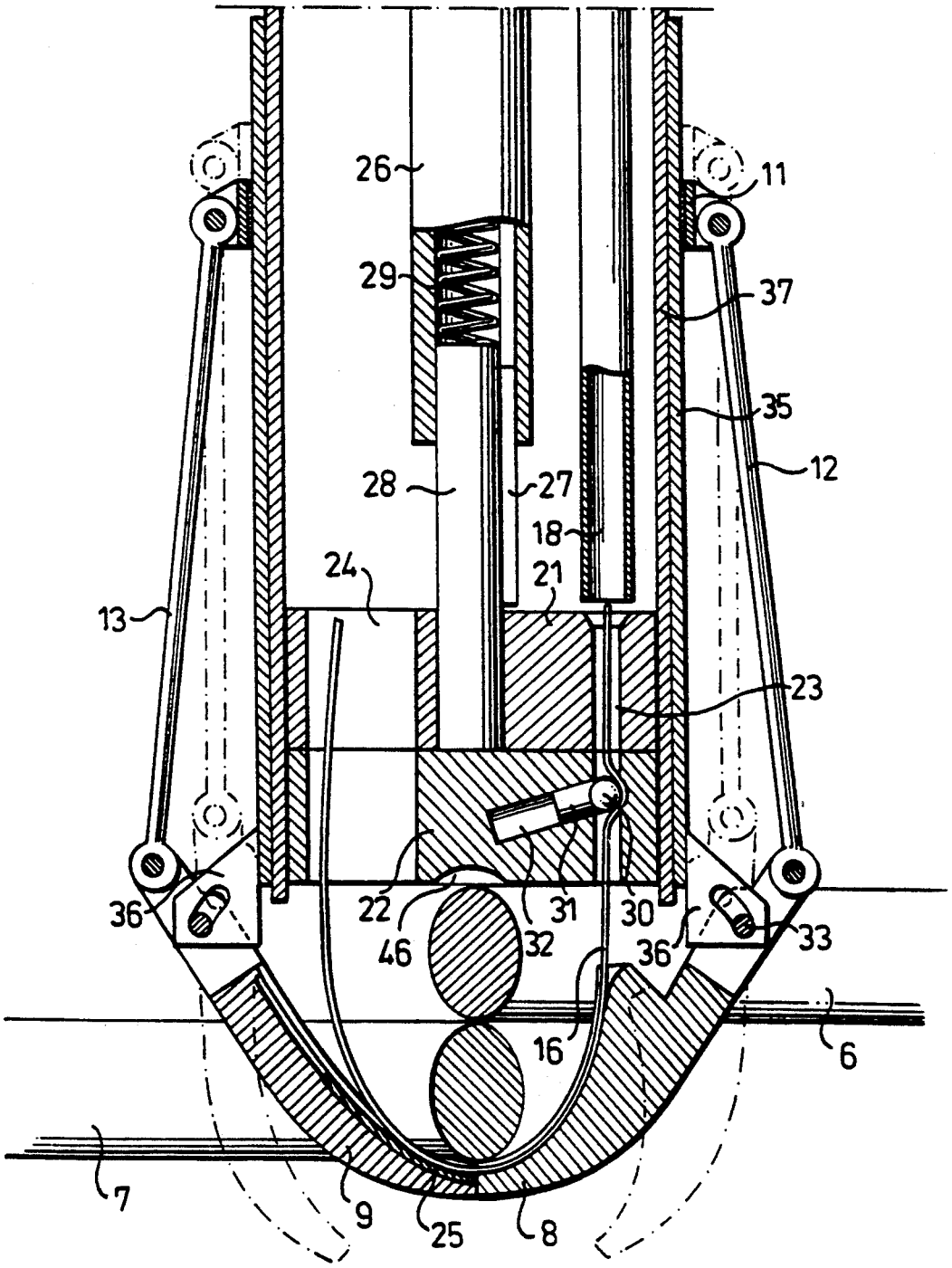
FIG. 6 is a view corresponding to FIG. 3, in which the machine has been adapted for tying reinforcement rods or bars with a bigger diameter.

FIG. 6 is a view corresponding to the view of FIG. 3. The machine illustrated in FIG. 6 is adapted for tying or lashing reinforcement rods 6 and 7 of larger diameter than the machine of FIG. 3. In the case of the FIG. 6 embodiment, an adjustment has been made to the position of an outer sleeve 35 on which the jaw attachment lugs 36 are mounted and along which the upper ends of the arms 12 and 13, connected to the ring 11, are slideably arranged. The position of the sleeve 35 can be adjusted in relation to an inner, stationary sleeve 37 with the aid of a spring-loaded locking pin 38, as illustrated more clearly in FIG. 7. Thus, the machine illustrated in FIG. 6 can be adapted to reinforcement rods of mutually different diameters, wherein all that is required in this regard is to move the outer sleeve 35 relative to the inwardly-lying sleeve 37 and to adjust the lengths of the lines 10 used for manipulating the jaws. This latter adjustment can be appropriately effected at the ends of the lines connected to the handle 47, see FIG. 1.

Figure 8A:
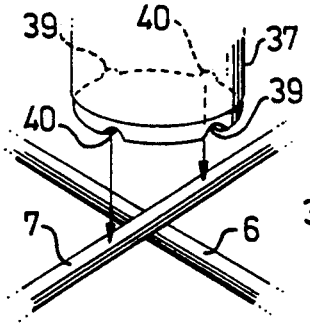
FIGS. 8A and 8B illustrate positioning of the machine on mutually crossing reinforcement rods or bars.
Figure 8B:
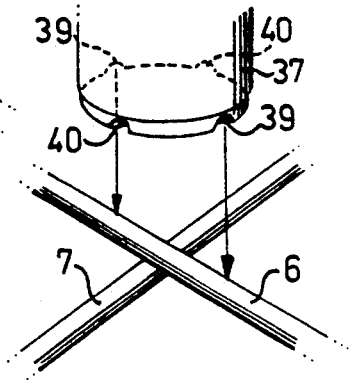

As will be seen from FIGS. 3 and 6, the inner sleeve 37, in which the twisting head 21, 22 rotates, supports the machine on the reinforcement rods 6 and 7. Accordingly, the bottom edge of the sleeve 37 is provided with two pairs of mutually opposing recesses 39 and 40, as illustrated in FIGS. 8A and 8B. Thus, when using the machine, the operator merely faces the machine on the reinforcement rods at a point of intersection, so that a pair of recesses will engage the uppermost rod, the twisting head being pressed upwards against the action of the spring 29, when required as a result of contact of the head with the reinforcement rod. In FIG. 8A the recesses 40 will therefore coact with the reinforcement rod 7, whercas in FIG. 8B the recesses 39 will coact with the reinforcement rod 6. The machine is correctly and reliably positioned in relation to the longitudinal directions of the two mutually crossing rods 6 and 7, in both instances As a result of the provision of two pairs of recesses in the sleeves 37, it is not necessary for the operator to keep on adjusting the machine in order to position the machine in accordance with which rod that lies uppermost of the two rods.

Figure 10A:
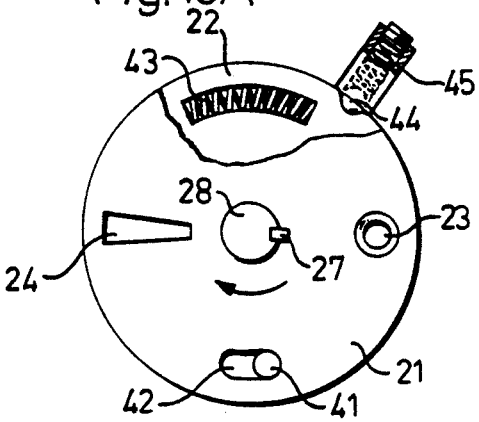
FIGS. 10A and 10B illustrate the twisting head from above, when at rest and when performing a twisting operation respectively.
Figure 10B:
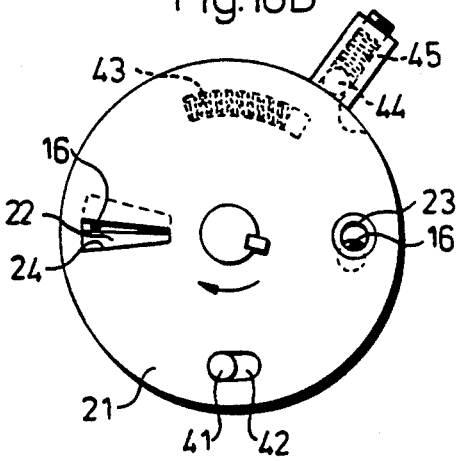

FIG. 9 illustrates the twisting head with the two disc-shaped bodies 21 and 22 in their rest positions, see also FIG. 10A. The bottom disc-shaped body 22 is provided with a dogging pin 41 which moves in a slot 42 in the upper body. The reference numeral 43 identifies a return spring for the disc-shaped body 21, and reference numeral 44 (FIG. 10A) identifies a ball which is activated by a spring 45 and which functions to affix the disc-shaped body 21 in its correct starting position and to exert a given initial resistance to initial rotation of the body, for reasons made apparent below.

Figure 11:
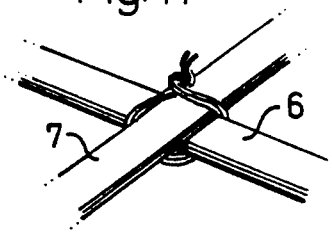
FIG. 11 illustrates the result of a twisting operation.

When using the described and illustrated machine, a wire-section 16 is introduced into the feed tube is and is pressed down through the twisting head by the plunger 20, until the upper end of the wire-section, located in the opening 23, is substantially flush with the upper surface of the disc-shaped body 21 and the forward end of the wire-section projects up through the slot-opening 24, also substantially flush with the upper surface of the body 21. The bottom disc-shaped body 22 is then rotated in a clockwise direction by the shaft 28, as indicated by the arrow, wherewith the ends of the wire-section 16 are clamped firmly in respective openings 23 and 24 as a result of relative rotation between the disc-like bodies 21 and 22. The initial clamping force is determined by the holding force of the ball 44, and the magnitude of the relative rotation between the disc-like bodies is limited by the pin 41, which subsequent to given rotation between the bodies dogs the upper body 21 in the rotational movement of the bottom body. This prevents the wire-sections from being severed as a result of a scissor action between the disc-like bodies 21 and 22. Twisting of the stirrup legs is completed after a few turns of the disc-shaped bodies and the result is illustrated in FIG. 11.

During this twisting operation, the mutually twined wire-ends are received in the cup-shaped recess 46 in the bottom surface of the bottom disc-shaped body. If so required, the twisting head can also be pressed upwards against the action of the spring 29.

Thus, the aforedescribed machine enables a tying operation to be carried out effectively, in a very simple fashion, essentially automatically in a standing position, with the use of straight, precut wire-sections.

It will be understood that the aforedescribed and illustrated embodiments can be modified in several respects within the scope of the following claims, for instance with regard to manoeuvring of the jaws and the construction of the twisting head. For example, the jaws can be operated with the aid of lines, gearwheels or the like, instead of rods. The positioning of the electric motor, battery and the external configuration of the machine can, of course, also be varied as desired. The manner in which the wire feed is accomplished can also be changed. For example, the wires can be fed down axially through an opening in the upper part of the machine.

I claim:

1. A machine for joining together mutually crossing rods with the aid of wires, particularly for tying reinforcement rods, said machine including a device (8, 9) having a curved wire-guide surface which is intended to be positioned so that said surface will substantially embrace the intersection point of two rods (6, 7) on three sides thereof, means (18–20) for feeding at least one wire to said device, so that the wire is bent by said guide surface to the shape of a wire-stirrup surrounding said intersection point on three sides thereof, and a rotatable twisting head (21, 22) which functions to twist the free legs of the stirrup on the fourth side of said intersection point, wherein the machine further includes a feed tube (18) for severed, straight wire-sections (16) of predetermined lengths, the lower end of said tube being located above an opening (23) in the twisting head (21, 22) in line with a part of said guide surface; and further comprising means (20) moveable in the tube (18) for coaction with a wire-section (16) inserted therein, such as to press down and displace said wire-section along said guide surface and forming of said wire-section to a stirrup-like shape, wherein the device provided with a curved guide surface includes two curved jaws (8, 9) which are pivotal towards one another; the inner surfaces of the jaws are provided with open wire-section guide grooves, the groove in the curved inner surface of the jaw (8) which first meets the forward end of the wire-section (16) has a substantially circular curvature; and the curvature of the groove in the second jaw (9) has a radius of curvature which is greater than the radius of curvature of the groove in the first jaw.

2. A machine according to claim 1, wherein the means arranged for movement in the tube (18) has the form of a plunger (20) which acts on the upper end of respective wire-sections (16).

3. A machine for joining together mutually crossing rods with the aid of wires, particularly for tying reinforcement rods, said machine including a device (8, 9) having a curved wire-guide surface which is intended to be positioned so that said surface will substantially embrace the intersection point of two rods (6, 7) on three sides thereof, means (18–20) for feeding at least one wire to said device, so that the wire is bent by said guide surface to the shape of a wire-stirrup surrounding said intersection point on three sides thereof, and a rotatable twisting head (21, 22) which functions to twist the free legs of the stirrup on the fourth side of said intersection point, wherein the machine further includes a feed tube (18) for severed, straight wire-sections (16) of predetermined lengths, the lower end of said tube being located above an opening (23) in the twisting head (21, 22) in line with a part of said guide surface; and further comprising means (20) moveable in the tube (18) for coaction with a wire-section (16) inserted therein, such as to press down and displace said wire-section along said guide surface and forming of said wire-section to a stirrup-like shape, wherein the device provided with a curved guide surface includes two curved jaws (8, 9) which are pivotal towards one another; the inner surfaces of the jaws are provided with open wire-section guide grooves, and the jaws (8, 9) are journalled so that said jaws will move axially when pivoting relative to one another.

4. A machine according to claim 3, wherein the position of the jaw attachment means on the machine can be adjusted axially in a manner to adapt the machine to rods (6, 7) of mutually different diameters.

5. A machine for joining together mutually crossing rods with the aid of wires, particularly for tying reinforcement rods, said machine including a device (8, 9) having a curved wire-guide surface which is intended to be positioned so that said surface will substantially embrace the intersection point of two rods (6, 7) on three sides thereof, means (18–20) for feeding at least one wire to said device, so that said wire is bent by said guide surface to the shape of a wire-stirrup surrounding said intersection point on three sides thereof, and a rotatable twisting head (21, 22) which functions to twist the free legs of the stirrup on the fourth side of said intersection point, wherein the machine further includes a feed tube (18) for severed, straight wire-sections (16) of predetermined lengths, the lower end of said tube being located above an opening (23) in the twisting head (21, 22) in line with a part of said guide surface; and further comprising means (20) moveable in the tube (18) for coaction with a wire-section (16) inserted therein, such as to press down and displace said wire-section along said guide surface and forming of said wire-section to a stirrup-like shape, wherein the twisting head comprises two rotatably, disc-shaped bodies (21, 22), each provided with a pair of openings (23, 24) for receiving the legs of a wire-stirrup; and the discs are mounted for limited movement relative to one another such as to clamp the legs of the wire-stirrup firmly between the discs prior to a twisting operation.

6. A machine according to claim 5, wherein the openings (24) in the disc-shaped bodies intended for receiving the forward end of the wire (16) bent to stirrup form have an elongated shape in the radial direction.

7. A machine for joining together mutually crossing rods with the aid of wires, particularly for tying reinforcement rods, said machine including a device (8, 9) having a curved wire-guide surface which is intended to be positioned so that said surface will substantially embrace the intersection point of two rods (6, 7) on three sides thereof, means (18–20) for feeding at least one wire to said device, so that the wire is bent by said guide surface to the shape of a wire-stirrup surrounding said intersection point on three sides thereof, and a rotatable twisting head (21, 22) which functions to twist the free legs of the stirrup on the fourth side of said intersections point, wherein the machine further includes a feed tube (18) for severed, straight wire-sections (16) of predetermined lengths, the lower end of said tube being located above an opening (23) in the twisting head (21, 22) in line with a part of said guide surface; and further comprising means (20) moveable in the tube (18) for coaction with a wire-section (16) inserted therein, such as to press down and displace said wire-section along said guide surface and forming of said wire-section to a stirrup-like shape, wherein the twisting head (21, 22) is mounted for movement axially in a sleeve (37) surrounding said head, and the lower end of the sleeve is intended to rest on the rods (6, 7) to be joined together.

8. A machine according to claim 7, wherein the bottom edge of the sleeve (37) is provided with two pairs of diametrically opposed recesses (30, 40) which are intended to fit on the top of the rods (6, 7) to be jointed together and therewith correctly position the machine.

9. A machine for joining together mutually crossing rods with the aid of wires, particularly for tying reinforcement rods, said machine including a device (8, 9) having a curved wire-guide surface which is intended to be positioned so that said surface will substantially embrace the intersection point of two rods (6, 7) on three sides thereof, means (18–20) for feeding at least one wire to said device, so that the wire is bent by said guide surface to the shape of a wire-stirrup surrounding said intersection point on three sides thereof, and a rotatable twisting head (21, 22) which functions to twist the free legs of the stirrup on the fourth side of said intersection point, characterized in that the device provided with a curved guide surface includes two curved jaws (8, 9) which are pivotal towards one another; that the inner surfaces of the jaw are provided with open wire guide grooves; that the groove in the curved inner surface of the jaw (8) which first meets the forward end of the wire (16) has a substantially circular curvature; and in that the curvature of the groove in the second jaw (9) has a radius of curvature which is greater than the radius of curvature of the groove in the first jaw.

* * * * *